US005633704A

United States Patent [19]

Suzuki et al.

[11] Patent Number: 5,633,704

[45] Date of Patent: May 27, 1997

[54] IMAGE FORMING APPARATUS HAVING FIXING MEANS ERROR DETECTION

[75] Inventors: Yoshihiko Suzuki, Tokyo; Shokyo Koh, Yokohama, both of Japan

[73] Assignee: Canon Kabushiki Kaisha, Tokyo, Japan

[21] Appl. No.: 441,954

[22] Filed: May 16, 1995

Related U.S. Application Data

[63] Continuation of Ser. No. 124,629, Sep. 22, 1993, which is a continuation of Ser. No. 658,235, Feb. 20, 1991, abandoned.

[30] Foreign Application Priority Data

Feb. 20, 1990 [JP] Japan ..... 2-040233
Feb. 20, 1990 [JP] Japan ..... 2-040235

[51] Int. Cl.[6] ..... G03G 15/20

[52] U.S. Cl. ..... 399/69; 219/216; 399/33

[58] Field of Search ..... 355/282, 285, 355/289, 290; 219/216

[56] References Cited

U.S. PATENT DOCUMENTS

| | | | |
|---|---|---|---|
| 3,578,797 | 5/1971 | Hodges . | |
| 3,988,682 | 10/1976 | Mikonis | 219/501 X |
| 4,415,800 | 11/1983 | Dodge et al. | 219/216 X |
| 4,425,494 | 1/1984 | Enomoto et al. | 219/216 |
| 4,496,829 | 1/1985 | Black et al. | 219/497 |
| 4,719,489 | 1/1988 | Ohkubo et al. | 355/290 |
| 4,740,671 | 4/1988 | Kuroda et al. | 219/492 |
| 4,952,781 | 8/1990 | Kozaiku | 219/469 |
| 4,994,852 | 2/1991 | Matsuuchi et al. | 355/206 |
| 4,996,567 | 2/1991 | Watarai et al. | 355/290 |
| 4,998,121 | 3/1991 | Koh et al. . | |
| 5,026,276 | 6/1991 | Hirabayashi et al. . | |
| 5,027,160 | 6/1991 | Okada et al. . | |
| 5,040,022 | 8/1991 | Kinoshita et al. | 355/282 |
| 5,043,763 | 8/1991 | Koh et al. | 355/206 |
| 5,083,168 | 1/1992 | Kusaka et al. . | |
| 5,179,263 | 1/1993 | Koh et al. | 219/216 |
| 5,196,675 | 3/1993 | Suzuki et al. | 219/216 |
| 5,262,834 | 11/1993 | Kusaka et al. | 355/285 |

FOREIGN PATENT DOCUMENTS

| | | |
|---|---|---|
| 0295901 | 12/1988 | European Pat. Off. . |
| 60-162278 | 8/1985 | Japan . |
| 60-217380 | 10/1985 | Japan . |
| 60-220379 | 11/1985 | Japan . |
| 61-228484 | 10/1986 | Japan . |
| 1-178992 | 7/1989 | Japan . |
| 1248172 | 10/1989 | Japan . |
| 2123343 | 2/1984 | United Kingdom . |

*Primary Examiner*—William J. Royer

[57] ABSTRACT

An image forming apparatus includes image forming means for forming an unfixed image on a recording material; a fixing device for heat-fixing the unfixed image on the recording material, the fixing device including a heater for heating the unfixed image, the heater being controlled at a predetermined temperature during a fixing operation, and a temperature detecting element for detecting the temperature of the heater, wherein power supply to the heater is started after production of image formation start signal; and a discriminating device for discriminating an error in the fixing device on the basis of the temperature of the heater a predetermined period after start of power supply to the heater.

48 Claims, 10 Drawing Sheets

IMAGE FORMING APPARATUS HAVING FIXING MEANS ERROR DETECTION

This application is a continuation of application Ser. No. 08/124,629 filed Sep. 22, 1993, which is a continuation of application Ser. No. 07/658,235, filed Feb. 20, 1991, now abandoned.

FIELD OF THE INVENTION AND RELATED ART

The present invention relates to an image forming apparatus having fixing means for heat-fixing an unfixed image on a recording material, more particularly to an image forming apparatus having means for detecting an error in the fixing means.

A widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating. roller.

U.S. Pat. No. 3,578,797 discloses an image fixing apparatus using an endless belt.

These types of fixing apparatus requires that the heater is continuously supplied with electric power during the stand-by period with the result of waste of the electric energy.

U.S. Ser. No. 206,767 abandoned in favor of Ser. Nos. 688,333, 373,970, 435,247 abandoned in favor of Ser. Nos. 735,709, 440,380 abandoned in favor of Ser. Nos. 751,571, 440,678, and 444,802 and U.S. Patent Nos. 5,043,763, 4,998,121, 5,026,276, 5,027,160, and 5,083,168 which have been assigned to the assignee of this application, have proposed a novel image fixing apparatus in which the fixing operation is enabled in a short period of time from the start of the electric energy supply, and wherein the electric power supply to the heater may be started subsequent to the generation of the image formation start signal.

Where the power supply to the heater is started after the generation of the image formation start signal, it would be possible that the heater does not reach the predetermined fixing temperature by the time the recording material enters the fixing apparatus, if the voltage of the power source for supplying electric power to the heater is decreased, because the power supply to the heater is insufficient. If this occurs, the fixing operation would not be proper or would result in toner offset.

In addition, the fixing apparatus may fail due to an open circuit or non-contact in the temperature detecting element for detecting the temperature of the heater.

In the conventional heating roller fixing apparatus, an error in the fixing apparatus can be checked during the warming-up period until the surface temperature of the heating roller reaches a predetermined level. However, in the case wherein the power supply to the heater is started after the generation of the image formation start signal, it is not possible to check the error before image formation.

The error in the fixing apparatus could be checked after the heater temperature is raised. However, because of the variation in the heater temperature during the stand-by period of the apparatus, there is a liability that the normal situation is discriminated as being erroneous.

SUMMARY OF THE INVENTION

Accordingly, it is a principal object of the present invention to provide an image forming apparatus wherein the image forming operation can be prohibited when the power source voltage lowers.

It is another object of the present invention to provide an image forming apparatus wherein an error in the fixing means can be discriminated after generation of an image formation starting signal.

It is a further object of the present invention to provide an image forming apparatus wherein an error in the fixing means can be discriminated on the basis of the temperature of the heater a predetermined period after the start of the power supply to the heater.

It is a yet further object of the present invention to provide an image forming apparatus wherein an error in the fixing means can be discriminated on the basis of the heater temperature when a leading edge of a recording material reaches a predetermined position.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 is an enlarged sectional view of an image fixing apparatus.

DESCRIPTION OF THE PREFERRED EMBODIMENTS

Figure 1:
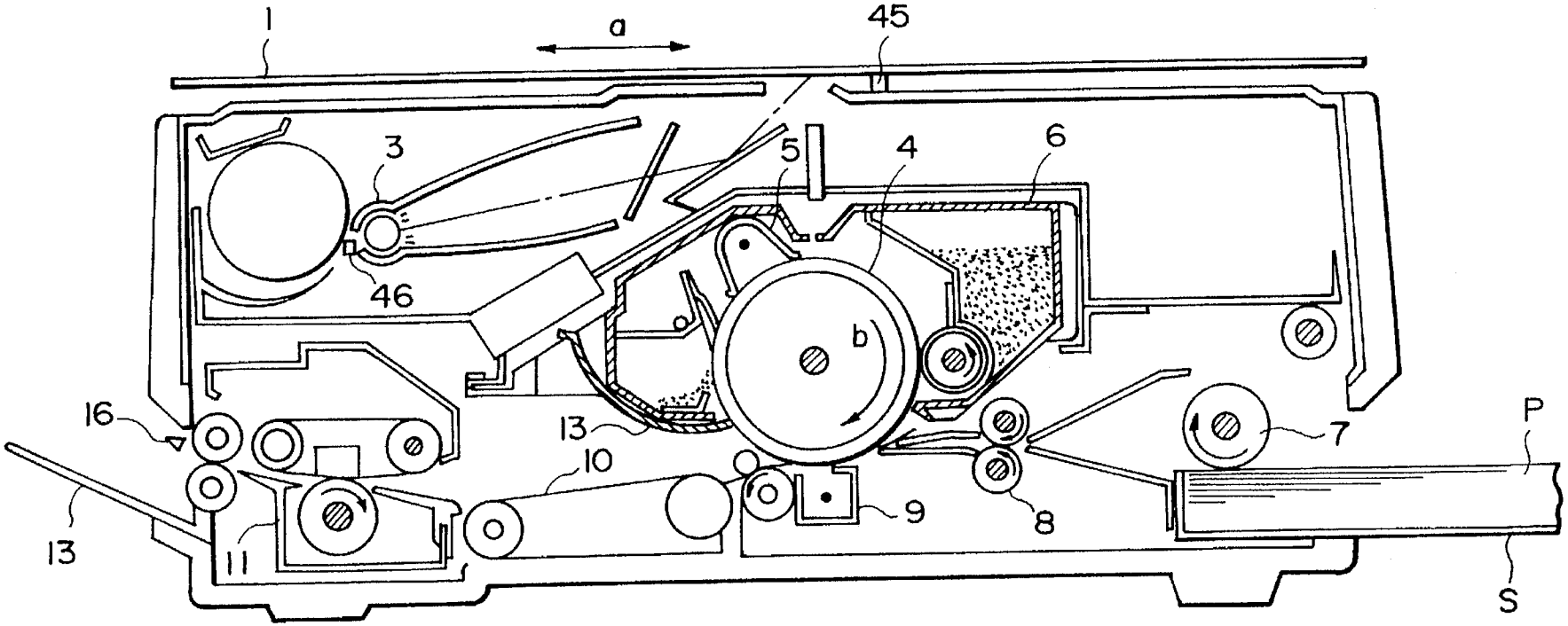
FIG. 1 is a sectional view of an image forming apparatus according to a first embodiment of the present invention.

Referring to FIG. 1, there is shown an image forming apparatus according to an embodiment of the present invention. It comprises an original supporting carriage 1 made of transparent material such as glass and reciprocate in a direction to scan an original. Right below the original carriage 1, an array 2 of a short focus imaging elements is disposed. An original placed on the original carriage 1 is illuminated by an illumination lamp 3, and the reflected light image is projected through a slit and through said array onto a photosensitive drum 4.

The photosensitive drum 4 rotates in a direction b. The photosensitive drum 4 has a zinc oxide photosensitive layer or an organic photoconductor photosensitive layer or the like. A charger uniformly charges the surface of the photosensitive drum 4. The drum 4 thus uniformly charged by the charger is exposed to the image light through the array 2, so that an electrostatic latent image is formed, which is in turn visualized with powdery toner made of heat-softening or heat-fusible resin by a developing device. On the other hand, a sheet (recording material) P accommodated in a cassette S is fed to the drum 4 by a pick-up roller 7 and registration rollers 8 rotated in synchronism with the image on the photosensitive drum 4. The toner image formed on the photosensitive drum 4 is transferred onto the sheet P by a transfer discharger 9. Thereafter, the sheet P is separated from the drum 4 by a known separating means, and is introduced along the conveying guide 10 into an image fixing apparatus 11 where it is subjected to the heat-fixing operation. Then, the sheet is discharged onto the tray 13. After the toner image has been transferred, the residual toner remaining on the photosensitive drum is removed by a cleaner 12.

Figure 2A:
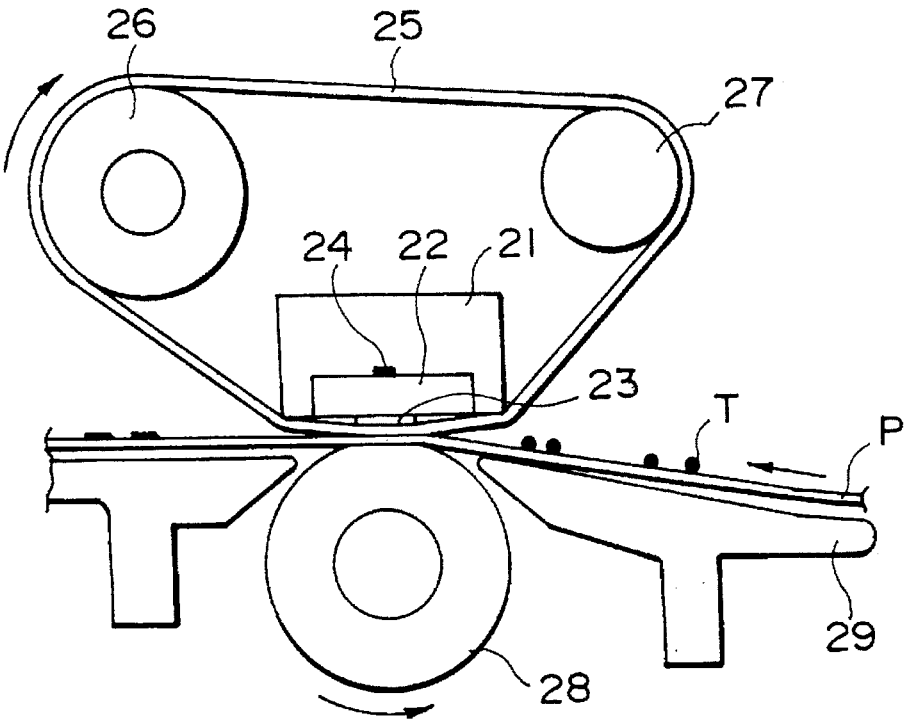
FIG. 2A is an enlarged sectional view of an image fixing apparatus used in the image forming apparatus of FIG. 1.

FIG. 2 is an enlarged sectional view of an image fixing apparatus used in the apparatus of FIG. 1. A heater 21 is in the form of a low thermal capacity linear heater fixed on the apparatus. For example, it comprises alumina base 22 having good thermal conductivity and having a thickness of 1.0 mm, a width of 10 mm and a length of 270 mm, and a heat generating resistor material 23 generating heat upon power supply thereto and having a width of 1.5 mm. The material is applied on the base 22 and is connected with the power source at the longitudinal ends thereof. The heat generating resistor material 23 is supplied with DC 100 V in the form of a pulse wave of 20 msec period. The pulse width thereof is controlled in a range from 0.5 msec–5 msec so that a temperature detecting element 24 in the form of a thermister in this embodiment detects a constant temperature, 180° C., for example.

A fixing film 25 moves in sliding contact with the heater 21 thus controlled to be a constant temperature. An example of the fixing film comprises a pure heat resistive resin base film having a thickness of 20 micron without filler material, made of PI (polyimide), PEI (polyether imide), PES (polyether sulfone), and a coating layer of 10 microns thickness having good parting property at the image contactable side of the base film, the coating layer being of fluorinated resin such as PTFE (tetrafluoroethylene resin) or PFA (perfluoroalkoxy) added with conductive material, the coating layer having a thickness smaller than the thickness of the base film. In order to reduce the thermal capacity to permit quick start, the total thickness of the film is preferably less than 100 microns, and further preferably less than 40 microns.

A driving roller 26 and a follower roller 27 function to apply tension to the film and drive it in a direction indicated by an arrow without a crease. A pressing roller 28 has a rubber elastic layer made of silicone rubber or the like having a good parting property, and it presses the film to the heater with the total pressure of 4–7 kg and rotates together with the film. The unfixed toner T on the sheet P is introduced into the fixing station through an inlet guide 29. The image is fixed by the heat from the heater.

Figure 2B:
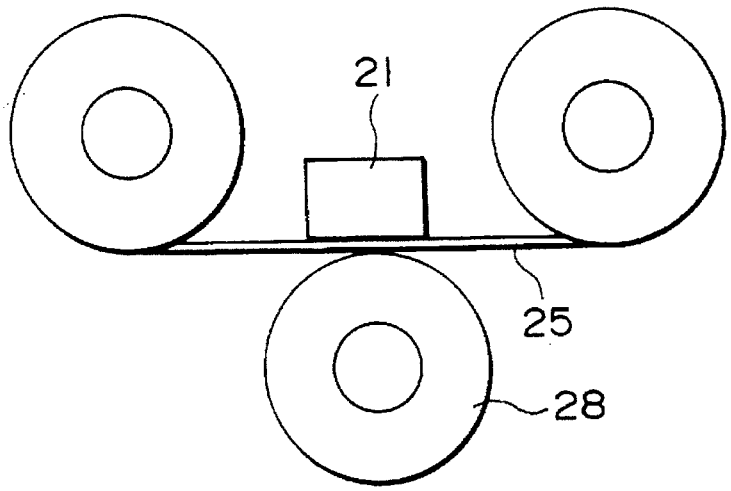
FIG. 2B is a sectional view of a modified image fixing apparatus usable with the image fixing apparatus according to the present invention.

In this embodiment, the fixing film is in the form of an endless belt. However, it may be in the form of non-endless belt, as shown in FIG. 2B.

Figure 3:
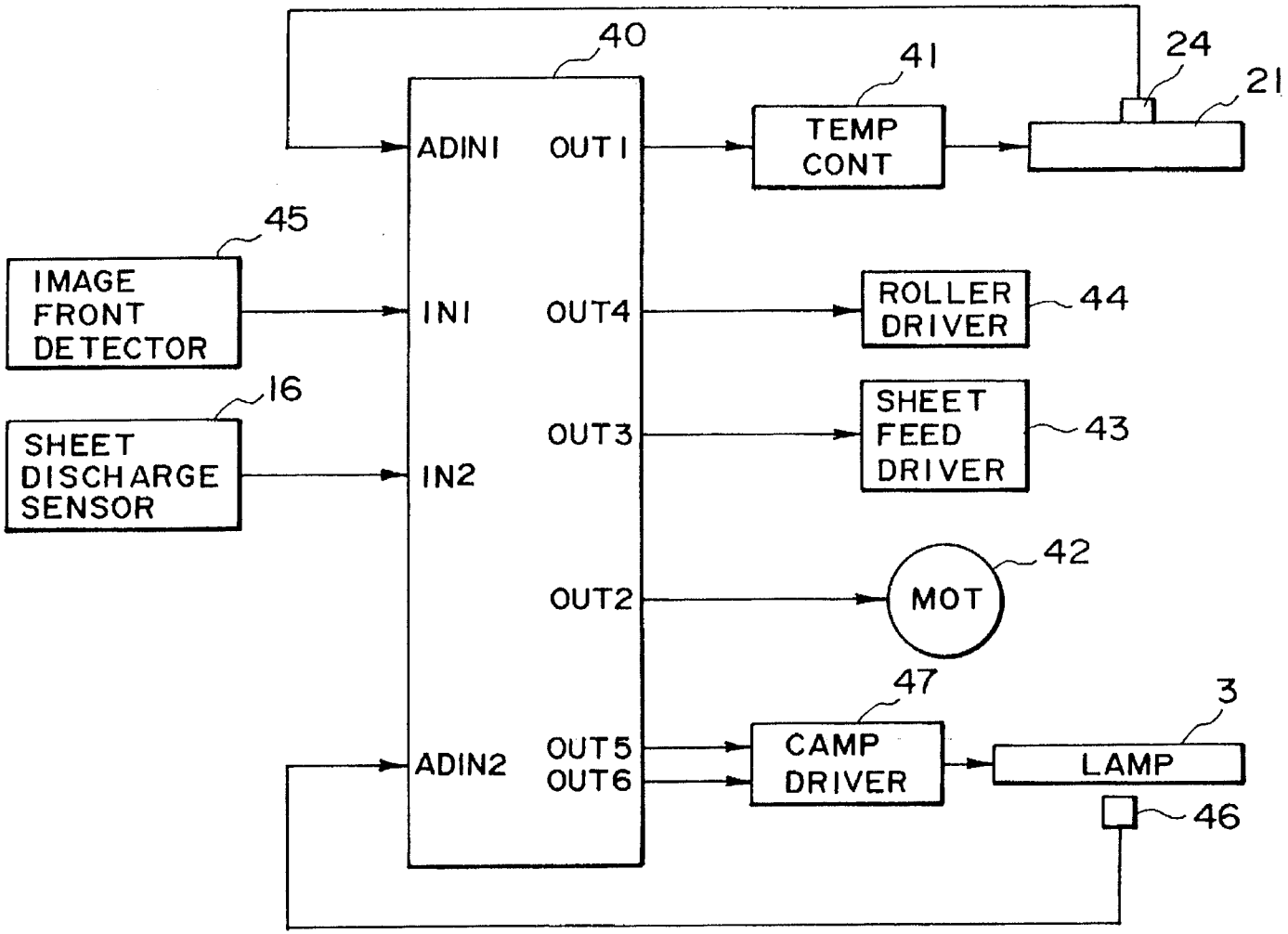
FIG. 3 is a block diagram of an electric system of the apparatus according to the first embodiment.

FIG. 3 is a block diagram of a sequential control system of the apparatus of FIG. 1. It comprises control means 40 having, in this embodiment, a microcomputer and logic elements or the like. The control means 40 has an input port IN1 which receives an image lead signal from an image lead detector 45 for detecting an image lead timing signal produced by an image lead timing member (not shown) mounted on an original supporting carriage 1. It also comprises an input port IN2 receives a sheet discharge sensor signal from a sheet discharge sensor 16 disposed at a sheet discharge side of the fixing apparatus. The control means 40 also comprises an output port OUT1 which produces a temperature control permission signal for the fixing apparatus to a temperature controller 41 for controlling the temperature of the heater 21. The temperature signal from the temperature sensing element 24 mounted on the alumina base plate of the heater 21 is supplied to an input contact ADIN1. From the output port OUT2, a driving signal is produced and transmitted to a driving motor 42 for driving the main assembly of the image forming apparatus and for driving the fixing film described hereinbefore. An output port OUT3 produces a sheet feed drive signal for a sheet feed driver 43. From an output port OUT4, a conveying roller driving signal is produced for a conveying roller driver 44. Designated by a reference numeral 47 is a fluorescent lamp driving means. From an output port OUT5, a fluorescent lamp filament preheating signal is produced, and from an output port OUT6, a fluorescent actuating signal is output to actuate the fluorescent lamp 3. A signal indicative of the light quantity from a light quantity detecting element 46 disposed adjacent to the fluorescent lamp 3 is supplied to a contact ADIN2. The control means further comprises means for receiving input signals and producing output signals necessary for the operation of the main assembly of the image forming apparatus, although they are not shown in the figure. The microcomputer in the control means 40 includes a ROM having programs such as a sequential operation program for the image forming apparatus, a RAM and a non-volatile RAM maintaining the memory content even if the power supply to the microcomputer 40 is shut off.

Figure 4:
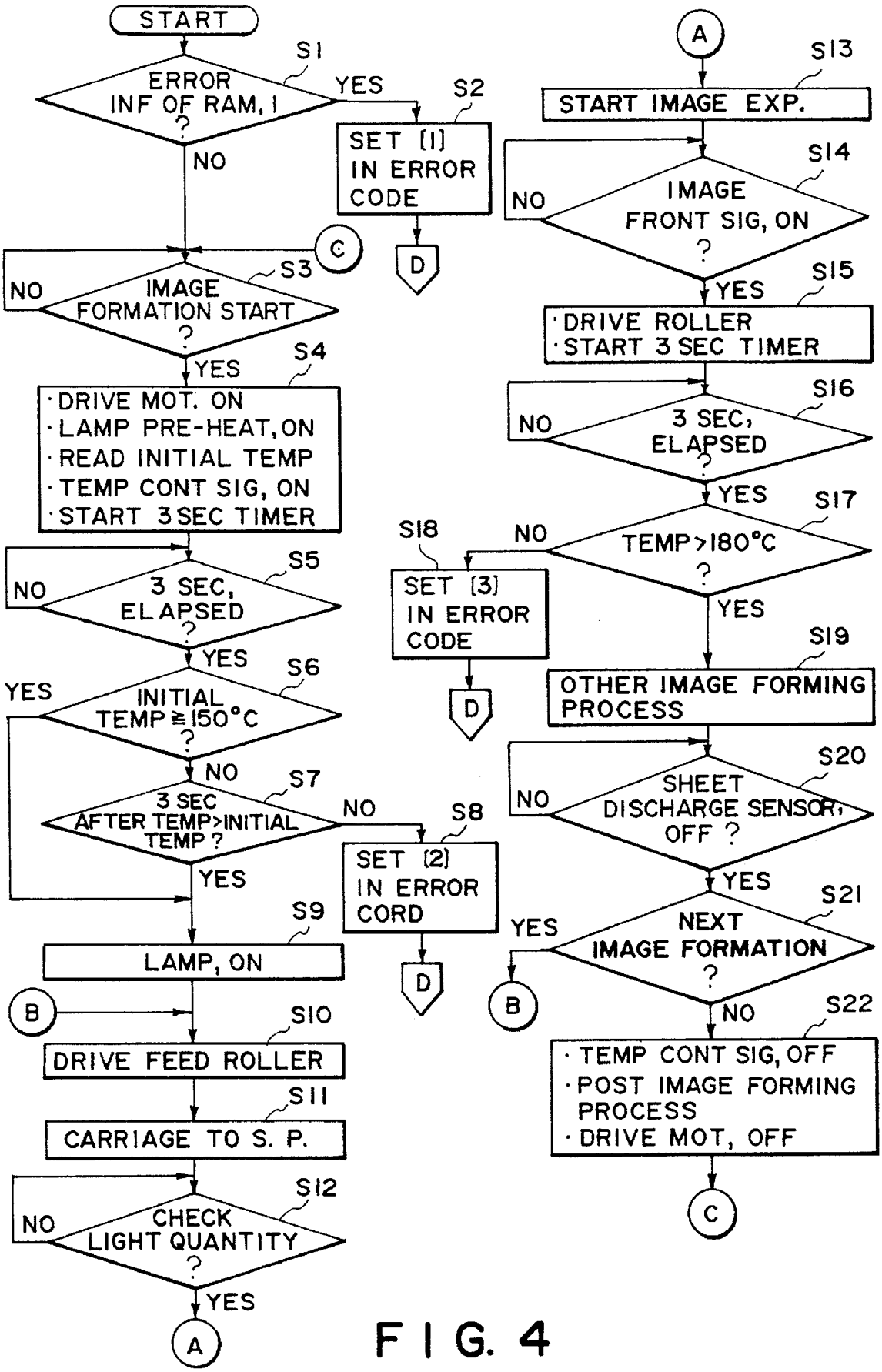
FIGS. 4 and 5 are flow charts illustrating the sequential operations of the apparatus of the first embodiment.
Figure 5:
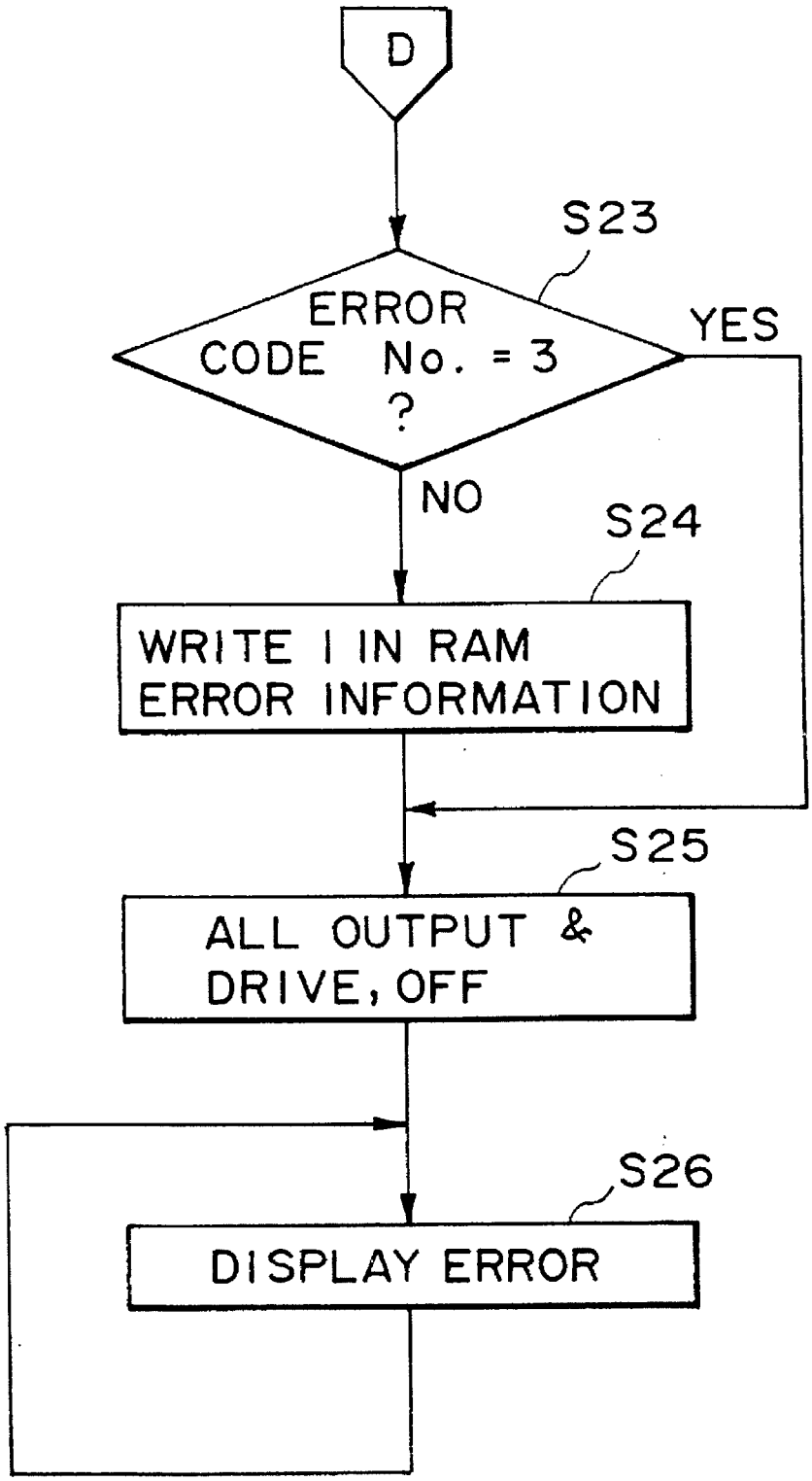

FIGS. 4 and 5 are flow charts illustrating the sequential operations of the image forming apparatus of this embodiment. The sequential operations are carried out in accordance with the program stored in the ROM in the microcomputer of the control means 40. When the main switch of the apparatus is actuated, the first step S1 is executed, by which the discrimination is made as to whether or not 1 is in an error information bit in the non-volatile RAM. If 0 is in the bit, step 3 is carried out. If 1 is therein, step 2 is executed. At step S2, "1" is set in an error code number, and the operation proceeds to step S23. At step 3, the discrimination is made as to whether or not the image formation start signal is produced by depression of a copy start button (not shown), in other words, whether or not the image formation is to be started. If it is not to be started, the operation returns to step 3, by which the apparatus is under the stand-by state. If the results of the discrimination at the step S3 is affirmative, the operation proceeds to step S4. At step S4, in order to start the image forming operation, the driving motor 42 is first actuated, and subsequently, the fluorescent filament pre-heating signal is produced, and thereafter, the initial temperature of the heater 21 from the temperature sensor 24 is read and is stored in a predetermined RAM.

Then, the temperature control permission signal for the fixing apparatus is produced, upon which the power supply to the heat generating resister material 23 is started.. Simultaneously, a 3 sec timer is started, and the operation proceeds to step S5, where the discrimination is made on the basis of the timer as to whether or not 3 sec has elapsed from the power supply start to the heater. If so, the operation proceeds to step S6. If not, the operation returns to the step S5 to await 3 sec. At step S6, the discrimination is made as to whether or not the initial temperature of the heater 21 read in the step S4 is not less than 150° C. If it is not less than 150° C., step S9 is executed. If it is less than 150° C., step S7 is executed. At the step S7, the temperature of the heater 21 from the sensor 24 at the point of time which is 3 sec after the start of the power supply to the heater 21 is read, and the comparison is made between the temperature and the initial temperature of the heater upon the start of the power supply before the temperature rise of the heater 21. If the temperature is higher than the initial temperature, that is, if the temperature of the heater 21 rises, the operation proceeds to step S9. If not, that is, if the temperature of the heater 21 does not rise, step S8 is executed. If the temperature detected by the temperature sensor 24 does not rise even after the heater 21 is energized for 3 sec, it is deemed that the fixing apparatus in error due to open circuit of the power supply circuit, open circuit of the temperature sensor or the like. In this manner, the failure in the fixing apparatus can be discriminated after the production of the image formation start signal and before the start of the recording material feed.

At step S8, "2" is set in the error code number, and the operation proceeds to step S23. At step S9, the fluorescent filament pre-heating signal is stopped, and simultaneously, the fluorescent light actuating signal is produced to actuate the fluorescent lamp 3 for illuminating the original is actuated, and then, step S10 is carried out, by which a sheet feed signal SL1 is produced to feed the sheet P until it abuts the conveying rollers 8. Then, step S11 is executed by which the original supporting carriage 1 is moved to an image exposure start position, and the operation proceeds to step S12. At step S12, the discrimination is made as to whether or not the quantity of light of the fluorescent lamp 3 from the light quantity detecting element 46 reaches a predetermined level or not. If so, step S13 is executed, and if not, the operation returns to the step S12 to await the light quantity reaching the predetermined level. At step S13, the image exposure operation is started, and the operation proceeds to step S14. At step S14, the discrimination is made as to whether or not the image lead signal R from the image lead detecting means 45 is high or low. If it is low, the operation returns to the step S14. This is repeated until the image lead signal R becomes high. If the image lead signal R becomes high, a step S15 is executed so that the conveying roller driving signal SL2 is actuated to start the feeding of the sheet P which is awaited by the conveying rollers 8. Also, the 3 sec timer is started, and the operation proceeds to step S16. At step S16, the discrimination is made using the 3 sec timer as to whether or not 3 sec has elapsed from the start of the feeding of the sheet P. If so, step 17 is executed, and if not, the operation returns to step S16 to await 3 sec.

The point of time 3 sec after the start of the sheet conveyance by the conveying rollers 8 is the point of time immediately before the sheet P enters the fixing apparatus 11.

At step S17, the temperature of the heater 21 from the temperature sensor 24 is read, and the discrimination is made as to whether or not the temperature is equal to or higher than 180° C. (fixing temperature). If so, the operation proceeds to step S19. If not, it proceeds to step S18. At step S18, "3" is set in the error code number, and the operation proceeds to step S23. At step S19, sequential operations necessary for the image formation are executed at proper timing, and then the operation proceeds to step S20. At step S20, the discrimination is made as to whether or not the sheet discharging sensor signal is off or not. If the sheet discharge sensor is on (sheet P is discharged), the operation returns to the step 20, by which the passage of the sheet P by the sheet discharge sensor 16 is awaited. If the sheet discharge sensor signal is off at step S20, the operation proceeds to step S21, where the discrimination is made as to whether or not the next image forming operation is to be continued. If so, the operation returns to the step S10, and the above-described operations thereafter are repeated. If the next image formation is not performed as a result of discrimination at step S21, that is, if the image forming operation is terminated, the operation proceeds to step S22, where the temperature control permission signal for the fixing apparatus is rendered off, by which the power supply to the heater is shut off. Then, the charge on the photosensitive drum 4 is removed, and another post-processing operation is performed. Subsequently, the driving motor 42 is stopped, and the operation returns to the step S3.

FIG. 5 is a flow chart of the operations for clearing the error occurring in the operation shown in FIG. 4. At step S23, the discrimination is made as to whether or not the error code number is "3" or not. If so, step S24 is executed, where "1" is written in the error information bit in the non-volatile RAM, and step S25 is executed.

By writing the event of the error in the non-volatile RAM, the error detection is stored. The stored error detection is retained until a service person release it.

At step S25, all of the outputs and drive of the apparatus are deactuated, the operation proceeds to step S26, where an error in the fixing apparatus is displayed, and step S26 is made a permanent loop to prohibit prosecution of another program.

As will be understood from the foregoing, according to this embodiment, the error in the fixing means can be checked even in the apparatus wherein the power supply to the heater is started after the production of the image formation start signal in response to the actuation of the copy start button.

The checking of the error by the temperature rise of the heater from the start of the power supply for the purpose of checking the fixing means, is executed only when the heater temperature upon the start of the power supply is lower than a predetermined level. Therefore, the erroneous discrimination of the error can be prevented, for example, when the heater is maintained at the high temperature at the time of the start of the image formation because the continuous image forming operation is being performed.

Because the fixing apparatus error is discriminated if the temperature of the fixing apparatus does not reach a predetermined level at the point of time when the leading edge of the sheet P reaches a predetermined position, more particularly, the position immediately before the fixing apparatus, in this embodiment. Therefore, improper fixing or toner offset can be prevented.

The cause of the fixing means error in this case is due to the decrease of the voltage source voltage, and it is not attributable to the fixing apparatus itself, and therefore, the error detection can be reset, that is, the error detection is not written in the non-volatile memory. Therefore, when the voltage of the source restores, the operation of the fixing apparatus is enabled, thus enhancing operativity. In the case of the fixing means error in the other cases, the error of the fixing means is retained, that is, the error detection is written in the non-volatile RAM, by which the safety operation is assured.

Referring to FIGS. 6–9, a second embodiment of the present invention will be described.

Figure 6:
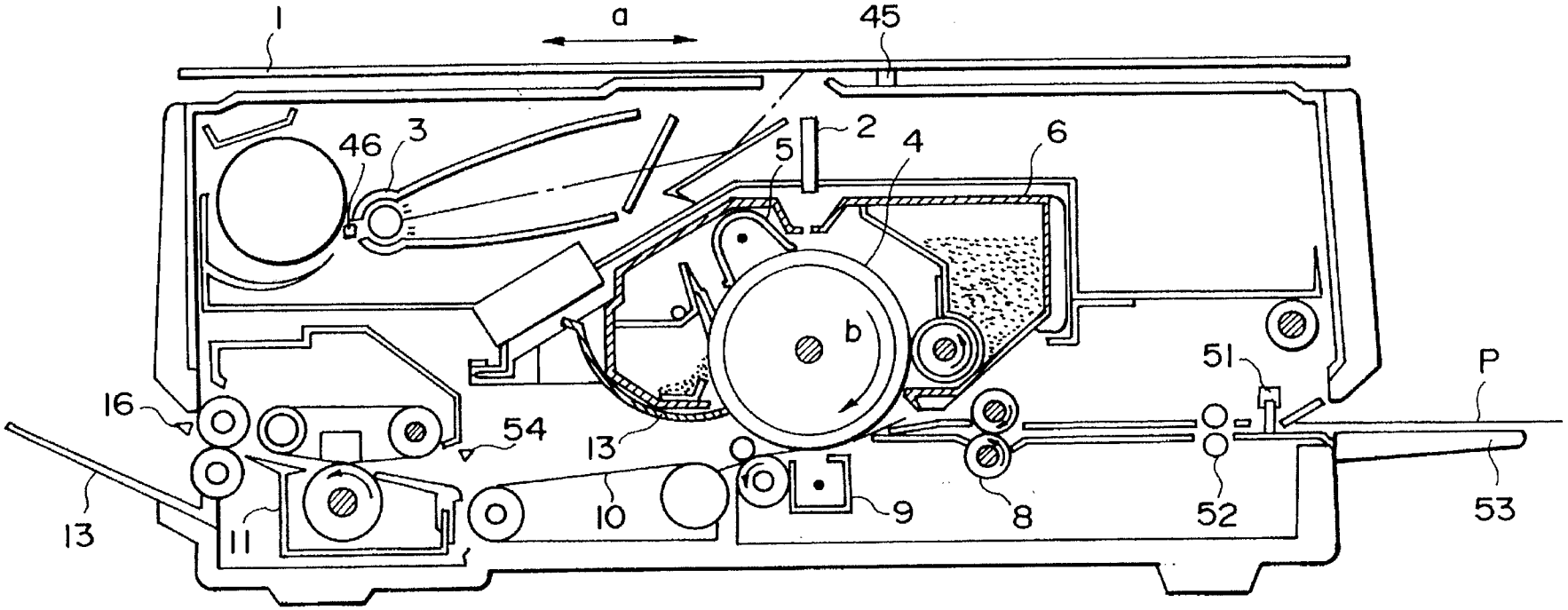
FIG. 6 is a sectional view of an image forming apparatus according to a second embodiment of the present invention.

FIG. 6 shows an image forming apparatus of this embodiment. In this embodiment, the sheet feeding mechanism for the recording material is in the form of a manual sheet feeding mechanism. The mechanism comprises a manual feed guide 53, a sheet feed sensor 51 for detecting the manual feed of the transfer or recording sheet, a sheet feeding roller 25 for feeding the recording sheet until it abuts the conveying rollers 8. The manual feed mechanism may replace the sheet feeding mechanism of the first embodiment or may be added thereto. In addition, there is provided an inlet sensor 52 at the inlet of the fixing apparatus to detect the reaching of the recording material to the inlet of the fixing apparatus. The apparatus of this embodiment is the same as the first embodiment in the other respects, and therefore, the detailed description thereof are omitted.

Figure 7:
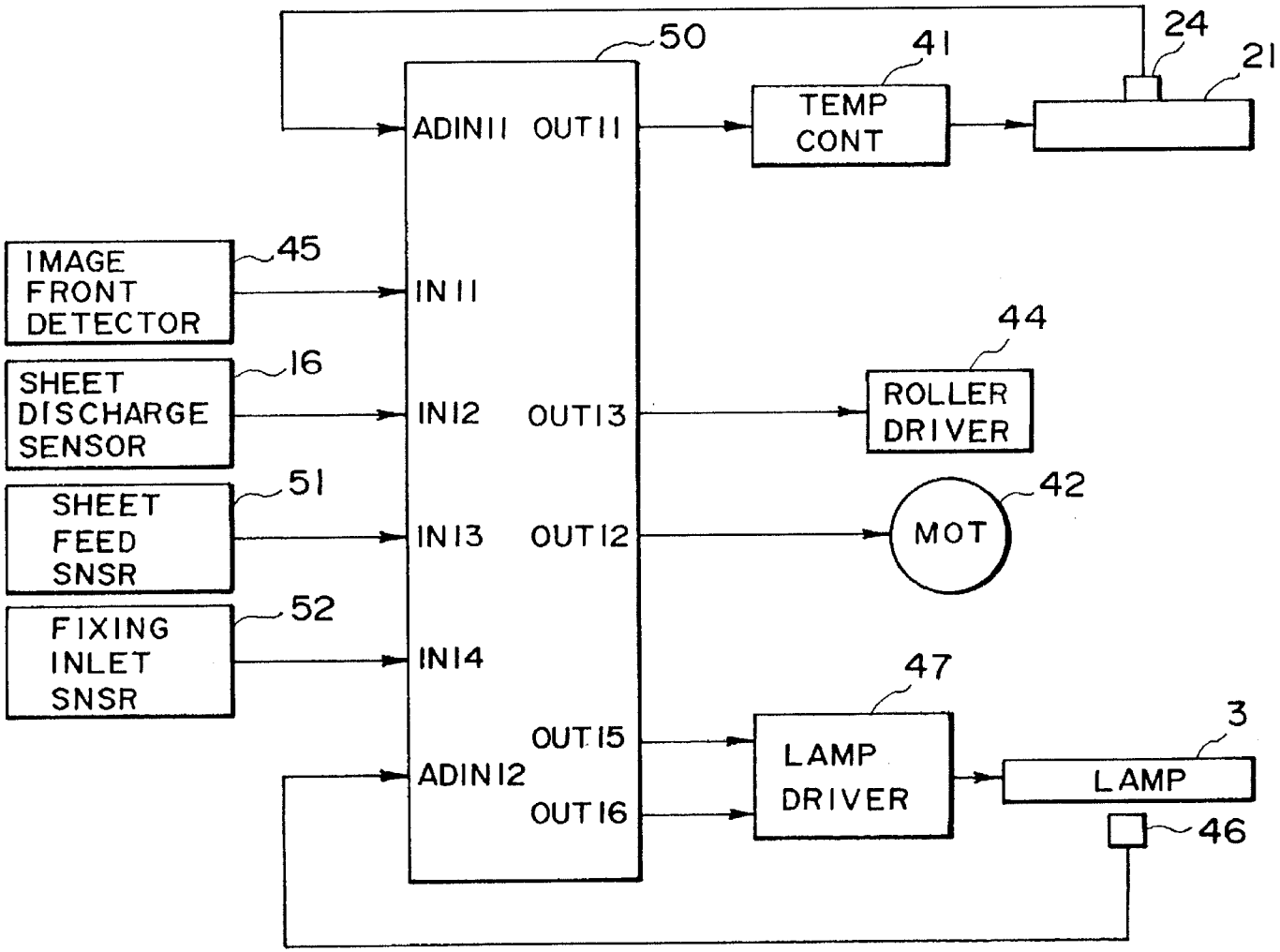
FIG. 7 is a block diagram of an electric system of the apparatus according to the second embodiment of the present invention.

FIG. 7 is a block diagram of the sequential control system for the apparatus of FIG. 6.

A control means 50 comprises a microcomputer and logic elements or the like in this embodiment. The control means 50 comprises an input port IN11 which receives an image lead signal from an image lead detecting means 45 for detecting an image lead timing signal produced by an image lead timing member (not shown) mounted on the original carriage 1. It also comprises an input port IN12 which receives a sheet discharge sensor signal from a sheet discharge sensor 16 provided at a sheet discharge side of the fixing apparatus. It further comprises an input port IN13 for receiving a sheet feed sensor signal from the sheet feed sensor 51. An additional input port IN14 receives a fixing apparatus input sensor signal from the inlet sensor 52. The control means 50 comprises an output port OUT11 which produces a permission signal for the temperature control of the fixing heater to temperature control means 41 for controlling the temperature of the heater. The temperature signal from the temperature sensing element disposed adjacent to the heater 21 is supplied to an input port ADIN11. From an output port OUT12, a conveyance drive signal is produced to a driving motor 42 to drive the main assembly of the image forming apparatus and the fixing film. From the output port OUT13, a conveying roller driving signal is produced to the conveying roller driver 44. Designated by a reference numeral 47 is a fluorescent lamp driving means. From an output port 15, a fluorescent lamp filament preheating signal is produced, and from an output port OUT16, a fluorescent lamp actuating signal is produced to actuate the fluorescent lamp 3. A light quantity signal from a light quantity detecting element 44 disposed adjacent to the fluorescent lamp 3 is supplied to the input port ADIN12. The control system further comprises various input ports and output ports required for performing the image forming operation, although they are not shown. The microcomputer of the control means 50 comprises ROM containing programs such as sequential operation program for the image forming apparatus, RAM and non-volatile RAM maintaining the memory content even if the power supply to the microcomputer 50 is shut off.

Figure 8:
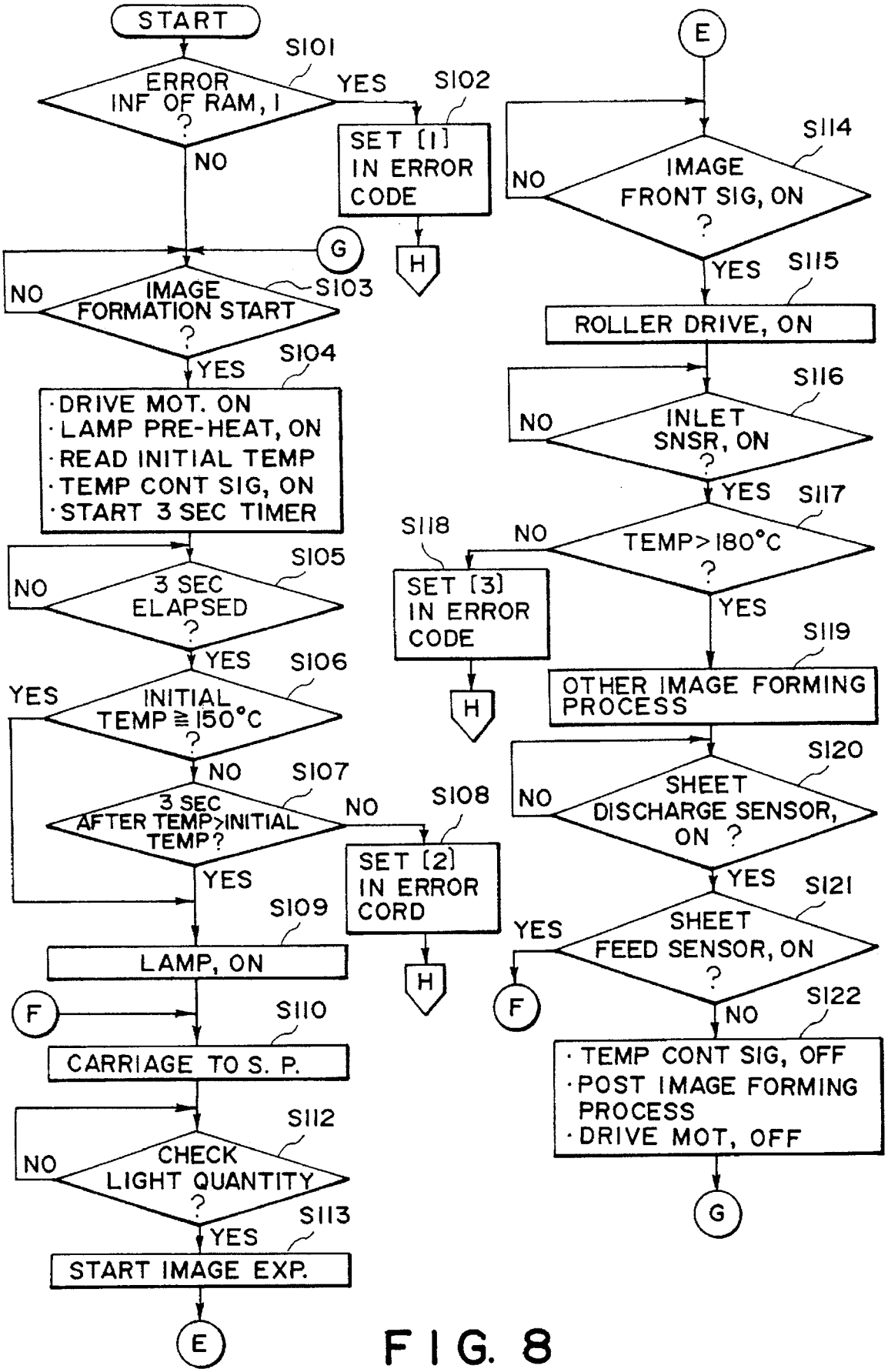
FIGS. 8 and 9 are flow charts showing sequential operations of the apparatus according to the second embodiment.
Figure 9:
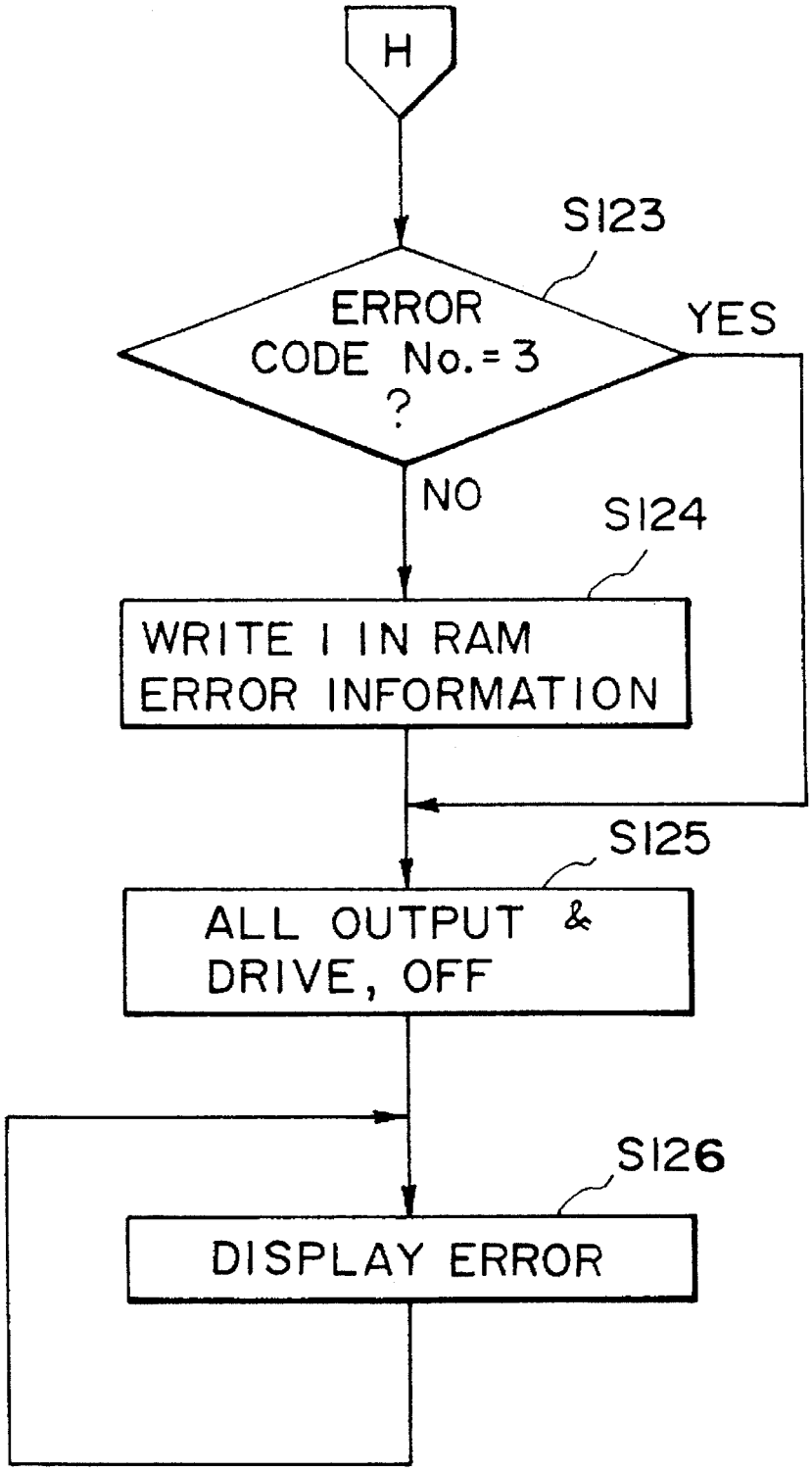

FIGS. 8 and 9 are flow charts illustrating the sequential operations of this embodiment. The program for the sequential operation is stored in the ROM of the microcomputer of the control means 50.

When the main switch is actuated, step S101 is executed. At step S101, the discrimination is made as to whether or not "1" is in the error information bit in the non-volatile RAM. If it is 0, step S103 is executed. If it is 1, the operation proceeds to step S102. At step S102, "1" is set in the error code number, and the operation proceeds to step S123. At step S103, the discrimination is made as to whether or not the sheet feed sensor 51 is actuated by the manual feed. If not, the operation returns to the step S103, by which the stand-by state is established. If the sheet feed sensor 51 is actuated as discriminated at the step S103, the operation proceeds to step S104. At step S104, in order to start the image forming operation, the driving motor 42 is first actuated, and then, the fluorescent lamp filament pre-heating signal is produced. Subsequently, the initial temperature of the heater 21 is read from the temperature detecting element 24, and the temperature is stored in a predetermined RAM.

Simultaneously with the start of the power supply to the heat generating resistor material 23 upon the production of the temperature control permission signal, a 3 sec timer is started, and the operation proceeds to step S105, where the discrimination is made as to whether or not 3 sec has elapsed. If so, the operation proceeds to step S106. If not, the operation returns to the step S105, where 3 sec is awaited. At step S106, the discrimination is made as to whether or not the initial temperature of the heater 21 read at step S104 is equal to or higher than 150° C. If so, the operation proceeds to step S109. If it is lower, the operation proceeds to step S107. At step S107, the temperature of the heater 21 from the temperature detecting element at the point of time which is 3 sec after the start of the power supply to the heater 21 is read, and it is compared with the initial temperature of the heater 21 at the time of the start of the power supply before the temperature rise of the heater 21. If the temperature is higher than the initial temperature, that is, if the temperature of the heater increases, the operation proceeds to step S109. If not, that is, if the temperature of the heater 21 does not increase, the operation proceeds to step S108. At step S108, "2" is set in the error code number, and the operation proceeds to step S123. At step S109, the fluorescent lamp filament pre-heating signal is produced, and simultaneously, the fluorescent lamp actuating signal is produced to actuate the fluorescent lamp. Then, the operation proceeds to step S110, where the original supporting carriage 1 is moved to the image exposure start position, and the operation proceeds to step S112. At step S112, the discrimination is made as to whether or not the quantity of the light of the fluorescent lamp 3 detected by the light quantity detecting element 46 reaches a predetermined level. If so, step S113 is executed, and if not, the operation returns to the step S112, where the reaching of the light quantity to the predetermined level is awaited. At step S113, the image exposure operation is started, and step S114 is executed, where the discrimination is made as to whether or not the image lead signal from the image lead detecting means 45 is actuated. If not, the operation returns to the step S114, and this is repeated until the image lead signal R is actuated. If the image lead signal R is actuated, the operation proceeds to step S115, where the conveying roller driving signal is actuated to start the conveyance of the sheet P, and step S116 is carried out. At step S116, the discrimination is made as to whether or not the fixing apparatus inlet sensor 52 is actuated. If so, that is, if the sheet P reaches the inlet of the fixing apparatus, the operation proceeds to step S117. If not, the operation returns to the step S116, by which the reaching of the sheet to the inlet is awaited. At step S117, the temperature of the heater from the temperature detecting element 24 is read, and the discrimination is made as to whether or not the temperature is equal to or higher than 180° C. (fixing temperature). If so, the operation proceeds to step S119, and if not, it proceeds to step S118. At step S118, "3" is set in the error code number, and the operation proceeds to step S123. At step S119, the sequential operations for the image forming operations are carried out at predetermined timing, and the operation proceeds to step S120, where the discrimination is made as to whether or not the sheet discharge sensor signal is high. If the sheet discharge sensor is high, that is, if the sheet P is discharged, the operation returns to the step S120, where the passage of the sheet P by the sheet discharge sensor 16 is awaited. If the sheet discharge sensor signal is low as discriminated at step 120, the operation proceeds to step S121. At step S121, the discrimination is made as to whether or not the sheet feed sensor 51 is actuated. If so, that is, if the subsequent image forming operation is to be performed, the operation returns to the step S110, so that the above-described operations are repeated. If, at step S121, the sheet discharge sensor is discriminated as being not actuated, that is, if the image forming operation is to be terminated, the operation proceeds to step S112, where the temperature control permission signal is rendered off, and the power supply to the heater is shut off. In addition, the post processing such as removal of the electric charge from the photosensitive drum 4 or the like is performed, and thereafter, the driving motor 42 is deactuated. Then, the operation returns to step S103.

At step S123, the discrimination is made as to whether or not the error code number is "3". If so, the operation proceeds to step S125. If not, step S124 is performed. At step S124, "1" is written in the error information bit in the non-volatile RAM, and then, step S125 is executed. At step S125, all of the outputs and the drive of the apparatus is deactuated, and step S126 is performed. At step S126, the error of the fixing apparatus is displayed, and the step S126 is made an eternal loop to prohibit execution of another program.

As described in the foregoing, according to this embodiment, the image formation start signal is produced by the manual setting of the sheet.

The arrival of the sheet P at the predetermined position is directly detected by detecting the sheet P at the fixing apparatus inlet. In this embodiment, too, the error in the fixing means can be checked even if the power supply to the heater is started after the production of the image formation start signal responsive to the manual set of the sheet P.

The checking of the error depending on the temperature rise of the heater from the start of the power supply for the purpose of checking the error in the fixing means, is effected only when the temperature of the heater upon the supper supply start is lower than a predetermined level.

The error in the fixing apparatus is detected if the temperature of the fixing apparatus has not yet reached a predetermined level at the point of time when the leading edge of the sheet P reaches a predetermined position, that is, immediately before the fixing apparatus in this embodiment.

The cause of the error of the fixing apparatus in this case is attributable to the drop of the voltage of the power source for the heater 21, and is not attributable to the failure of the fixing apparatus itself, and therefore, the fixing apparatus error is resettable, that is, it is not written in the non-volatile RAM. Accordingly, the apparatus becomes usable when the voltage of the power source restores. In the case of the other error in the fixing apparatus, the error detection is retained, that is, the error detection is written in the non-volatile RAM.

In the foregoing embodiment, the error information is written in the non-volatile RAM. A description will be provided as to an embodiment wherein the non-volatile RAM is not used.

Figure 10:
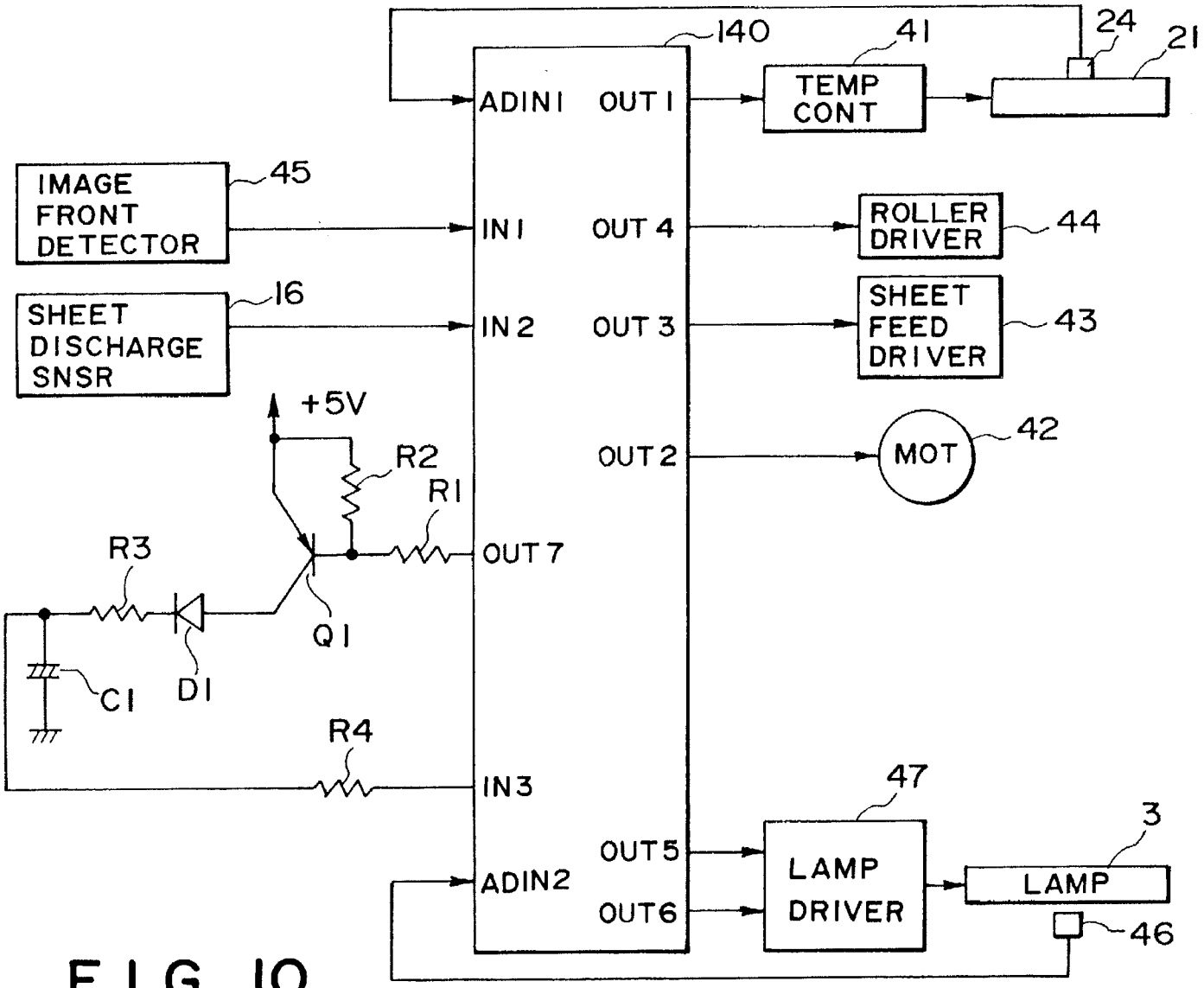
FIG. 10 is a block diagram of an electric system of an apparatus according to a third embodiment of the present invention.

FIG. 10 is a block diagram of an apparatus according to a third embodiment of the present invention. The apparatus of this embodiment has an additional input port IN3 and an output port 7 in addition to the elements shown in the block diagram for the first embodiment. The output port OUT7 of the microcomputer 140 is connected to a base of a transistor Q1 through a current limiting resistor R1. An emitter of the transistor Q1 is connected to the voltage source of +5 V. A collector is contacted to a capacitor C1 through a charging current limiting resistor R3. The capacitor C1 is connected to the input port IN3 of the microcomputer 140 through an input protection resistor R4. The microcomputer 140 is not provided with the above-described non-volatile RAM. The structures in the other respects are similar to the first embodiment, and therefore, the detailed description thereof are omitted for simplicity.

The operation of this apparatus will be described. When low level is produced at the output port 7, the transistor Q1 is actuated, so that the capacitor C1 is charged. Even if the power supply to the apparatus is shut off, the electric charge is retained in the capacitor C1, and therefore, by reading the level at the input port 3 upon power supply, the error detection can be retained without use of the non-volatile RAM.

However, since the capacitor spontaneously discharges, and therefore, it is difficult to retain it for a long period of time. From this standpoint, the non-volatile RAM is preferable.

In the foregoing embodiments, the power supply to the heater is started upon the production of the image formation start signal. However, if the heater is sufficiently quickly started, the power supply to the heater may be started at predetermined timing of the recording material passage after the start of the image forming operation.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an unfixed image on a recording material after receiving an image formation start signal;

fixing means for heat-fixing the unfixed image on the recording material during a fixing operation, said fixing means including a heater for heating the unfixed image, said heater being controlled at a predetermined temperature during the fixing operation, and wherein power supply to said heater is started after production of the image formation start signal;

a temperature detecting element for detecting the temperature of said heater; and abnormal condition detecting means for detecting an abnormality in accordance with an output of said temperature detecting element after the image formation start signal and before arrival of the recording material at said fixing means, and for producing an abnormality signal only when the abnormality is detected under circumstances where the output of said temperature detecting element upon start of the electric power supply to said heater indicates a temperature not higher than a predetermined level.

2. An apparatus according to claim 1, wherein said abnormal condition detecting means detects that said fixing means is not in order when the temperature of said heater is higher than a predetermined level a predetermined period after the start of power supply to said heater.

3. An apparatus according to claim 2, wherein the predetermined temperature is the temperature of said heater upon the start of the power supply thereto.

4. An apparatus according to claim 1, wherein said abnormal condtion detecting means detects that said fixing means is not in order when the temperature of said heater is not higher than the temperature of said heater upon the start of the power supply thereto by a predetermined degree.

5. An apparatus according to claim 1, wherein said image forming apparatus is a copying apparatus having a copy button thereon, and the image formation start signal is produced in response to actuation of said copy button.

6. An apparatus according to claim 1, further comprising manual feeding means for manually feeding the recording material and detecting means for detecting manual feed by said manual feeding means, wherein the image formation start signal is produced upon detection by said detecting means.

7. An apparatus according to claim 1, wherein when said abnormal condition detecting means detects that said fixing means is not in order, an output and drive of said apparatus is shut off.

8. An apparatus according to claim 1, further comprising display means for displaying data indicating an error in said fixing means when said abnormal condition detecting means detects an error in said fixing means.

9. An apparatus according to claim 1, wherein said fixing means further includes a film movable together with the recording material, and wherein the unfixed image on the recording material is heated by heat from said heater through the film.

10. An apparatus according to claim 9, wherein said heater includes a heat generating resistor generating heat upon electric power supply thereto, and wherein the heat generated by the heat generating resistor is transferred to the unfixed image through the film.

11. An apparatus according to claim 10, wherein said heater is stationary in use, and the film is in sliding contact with said heater.

12. An apparatus according to claim 9, wherein the film has a thickness of less than 100 microns.

13. An apparatus according to claim 12, wherein the film has a thickness less than 40 microns.

14. An image forming apparatus, comprising:

image forming means for forming an unfixed image on a recording material after receiving an image formation start signal;

fixing means for heat-fixing the unfixed image on the recording material during a fixing operation at a fixing position, said fixing means including a resistance heater, the temperature of which is elevatable from ambient temperature at receipt of the image formation start signal to a fixing temperature before the recording material reaches the fixing position, said resistance heater being controlled at a predetermined temperature during the fixing operation, and wherein power supply to said heater is supplied only after production of the image formation start signal;

a temperature detecting element for detecting the temperature of said heater; and discriminating means for discriminating whether said fixing means is in order, in accordance with a comparison between a predetermined level and an output of said temperature detecting element at a time when the recording material reaches a predetermined position, and before the recording material enters said fixing position, wherein a malfunction output signal is generated when said fixing means is not in order.

15. An apparatus according to claim 14, wherein said image forming means includes an image bearing member on which the unfixed toner image is formed, transfer means for transferring the unfixed image from said image bearing member to the recording material, wherein the predetermined position is between said transfer means and said fixing means.

16. An apparatus according to claim 14, wherein the predetermined position is immediately before said fixing means with respect to a movement direction of the recording material.

17. An apparatus according to claim 14, wherein said discriminating means discriminates an error on the basis of the temperature of the heater a predetermined period after the start of said feed of the recording material.

18. An apparatus according to claim 14, wherein said discriminating means discriminates an error in the operation of said fixing means when the temperature of said heater is not higher than a predetermined level when a leading edge of the recording material reaches a predetermined position.

19. An apparatus according to claim 14, wherein said discriminating means discriminates an error in the operation of said fixing means when the temperature of said heater is not higher than the temperature of said heater upon the start of the power supply thereto by a predetermined degree.

20. An apparatus according to claim 14, wherein said image forming apparatus having a copy button is a copying apparatus, and the image formation start signal is produced in response to actuation of said copy button.

21. An apparatus according to claim 14, further comprising manual feeding means for manually feeding the recording material and detecting means for detecting manual feed by said manual feeding means, wherein the image formation start signal is produced upon detection by said detecting means.

22. An apparatus according to claim 14, wherein when said discriminating means discriminates an error in the operation of said fixing means, an output and drive of said apparatus is shut off.

23. An apparatus according to claim 14, further comprising display means for displaying data indicating an error in the operation of said fixing means when said discriminating means discriminates an error in the operation of said fixing means.

24. An apparatus according to claim 14, wherein said fixing means further includes a film movable together with the recording material, and wherein the unfixed image on the recording material is heated by heat from said heater through the film.

25. An apparatus according to claim 24, wherein said heater includes a heat generating resistor generating heat upon electric power supply thereto, and wherein the heat generated by the heat generating resistor is transferred to the unfixed image through the film.

26. An apparatus according to claim 25, wherein said heater is stationary in use, and the film is in sliding contact with said heater.

27. An apparatus according to claim 24, wherein the film has a thickness of less than 100 microns.

28. An apparatus according to claim 27, wherein the film has a thickness less than 40 microns.

29. An image forming apparatus, comprising:

image forming means for forming an unfixed image on a recording material after receiving an image formation start signal;

fixing means for heat-fixing the unfixed image on the recording material during a fixing operation, said fixing means including a heater for heating the unfixed image, said heater being controlled at a predetermined temperature during the fixing operation, wherein power supply to said heater is started after production of the image formation start signal;

a temperature detecting element for detecting the temperature of said heater; and discriminating means for discriminating an abnormality of said fixing means in accordance with an output of said temperature detecting element, wherein said discriminating means effects its discriminating operation both in a period after input of an image formation start signal and before start of feeding of the recording material and in a period after start of the feeding of the recording material and before arrival of the recording material at said fixing means, and said discriminating means discriminates abnormality of said fixing means before start of feeding of the recording material and discriminates abnormality of power supplied to said fixing means after start of feeding of the recording material.

30. An apparatus according to claim 29, further comprising storing means for storing data representing an error in the operation of said fixing means discriminated by said discriminating means, wherein said storing means stores the data before the start of conveyance of the recording material, but does not store the data after start of the conveyance of the recording material.

31. An apparatus according to claim 30, wherein said storing means includes a non-volatile RAM, and information indicative of an error in the operation of said fixing means is written in the non-volatile RAM.

32. An apparatus according to claim 30, wherein said discriminating means discriminates an error in the operation of said fixing means when the temperature of said heater is not higher than a predetermined level at a predetermined point of time.

33. An apparatus according to claim 32, wherein the predetermined temperature level for the error discrimination after the start of the conveyance of the recording material is higher than a predetermined temperature level for discriminating the error before the start of the conveyance of the recording material.

34. An apparatus according to claim 29, wherein said discriminating means discriminates an error in the operation of said fixing means after the start of the conveyance of the recording material, when the recording material reaches a predetermined position.

35. An apparatus according to claim 34, wherein said image forming means includes an image bearing member on which the unfixed toner image is formed, and transfer means for transferring the unfixed image from said image bearing member to the recording material, wherein the predetermined position is between said transfer means and said fixing means.

36. An apparatus according to claim 34, wherein the predetermined position is immediately before said fixing means with respect to a movement direction of the recording material.

37. An apparatus according to claim 34, wherein the error discrimination before the start of the conveyance of the recording material is effected by said discriminating means a predetermined period after the start of power supply to said heater.

38. An apparatus according to claim 29, wherein said image forming apparatus having a copy button is a copying apparatus, and the image formation start signal is produced in response to actuation of said copy button.

39. An apparatus according to claim 29, further comprising manual feeding means for manually feeding the recording material and detecting means for detecting manual feed by said manual feeding means, wherein the image formation start signal is produced upon detection by said detecting means.

40. An apparatus according to claim 29, wherein when said discriminating means discriminates an error in the operation of said fixing means, an output and drive of said apparatus is shut off.

41. An apparatus according to claim 29, further comprising display means for displaying data indicating an error in the operation of said fixing means when said discriminating means discriminates an error in the operation of said fixing means.

42. An apparatus according to claim 29, wherein said fixing means further includes a film movable together with the recording material, and wherein the unfixed image on the recording material is heated by heat from said heater through the film.

43. An apparatus according to claim 42, wherein said heater includes a heat generating resistor generating heat upon electric power supply thereto, and the heat generated by the heat generating resistor is transferred to the unfixed image through the film.

44. An apparatus according to claim 43, wherein said heater is stationary in use, and wherein the film is in sliding contact with said heater.

45. An apparatus according to claim 42, wherein the film has a thickness of less than 100 microns.

46. An apparatus according to claim 45, wherein the film has a thickness less than 40 microns.

47. An apparatus according to claim 29, wherein the discrimination by said discriminating means before the start of the conveyance of the recording material is effected only when the temperature of said heater upon the start of the power supply thereto is not higher than a predetermined level.

48. An apparatus according to claim 1, wherein after elapse of the predetermined time, the recording material does not yet enter said fixing means.

* * * * *

UNITED STATES PATENT AND TRADEMARK OFFICE

CERTIFICATE OF CORRECTION

PATENT NO. : 5,633,704

DATED : May 27, 1997

INVENTOR(S) : Suzuki et al.

It is certified that error appears in the above-identified patent and that said Letters Patent is hereby corrected as shown below:

Title page, item

[56] REFERENCES CITED:

FOREIGN PATENT DOCUMENTS, "1248172" should read --1-248172--.
After Primary Examiner, insert --Attorney, Agent, or Firm-
Fitzpatrick, Cella, Harper & Scinto--.

COLUMN 2:

Line 2, "lowers." should read --is lowered.--.
Line 55, "reciprocate" should read --reciprocable--.
Line 56, "direction" should read --direction a--.

COLUMN 9:

Line 42, "supper" should read --power--.

COLUMN 11:

Line 52, "and" should be deleted.

Signed and Sealed this

Twenty-third Day of December, 1997

Bruce Lehman

*Attest:*

BRUCE LEHMAN

*Attesting Officer*

*Commissioner of Patents and Trademarks*